US012123070B2

(12) United States Patent
Inoue et al.

(10) Patent No.: US 12,123,070 B2
(45) Date of Patent: Oct. 22, 2024

(54) FERRITIC STAINLESS STEEL SHEET AND METHOD FOR PRODUCING SAME

(71) Applicant: JFE STEEL CORPORATION, Tokyo (JP)

(72) Inventors: Keishi Inoue, Tokyo (JP); Hidetaka Kawabe, Tokyo (JP); Masataka Yoshino, Tokyo (JP); Mitsuyuki Fujisawa, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 585 days.

(21) Appl. No.: 17/299,308

(22) PCT Filed: Nov. 27, 2019

(86) PCT No.: PCT/JP2019/046399
§ 371 (c)(1),
(2) Date: Jun. 3, 2021

(87) PCT Pub. No.: WO2020/121817
PCT Pub. Date: Jun. 18, 2020

(65) Prior Publication Data

US 2022/0017984 A1 Jan. 20, 2022

(30) Foreign Application Priority Data

Dec. 11, 2018 (JP) ..... 2018-231929

(51) Int. Cl.

| | |
|---|---|
| ***C21D 9/46*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/50*** | (2006.01) |
| ***C22C 38/52*** | (2006.01) |
| ***C22C 38/54*** | (2006.01) |
| ***C22C 38/60*** | (2006.01) |

(52) U.S. Cl.

CPC ..... *C21D 9/46* (2013.01); *C21D 6/004* (2013.01); *C21D 6/005* (2013.01); *C21D 6/008* (2013.01); *C21D 8/0205* (2013.01); *C21D 8/0226* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/50* (2013.01); *C22C 38/52* (2013.01); *C22C 38/54* (2013.01); *C22C 38/60* (2013.01); *C21D 2211/005* (2013.01)

(58) Field of Classification Search

CPC ..... C21D 9/46

See application file for complete search history.

(56) References Cited

U.S. PATENT DOCUMENTS

| | | | | |
|---|---|---|---|---|
| 3,650,731 | A | 3/1972 | Aggen | |
| 2009/0068490 | A1 | 3/2009 | Ozaki et al. | |
| 2011/0061777 | A1 | 3/2011 | Ishii et al. | |
| 2017/0275722 | A1 | 9/2017 | Nishida et al. | |
| 2018/0202023 | A1 | 7/2018 | Yoshino et al. | |
| 2019/0093192 | A1 | 3/2019 | Mitsunaga et al. | |
| 2020/0115785 | A1 | 4/2020 | Teraoka et al. | |
| 2020/0277690 | A1 * | 9/2020 | Yakushijin | C22C 38/04 |
| 2020/0385835 | A1 | 12/2020 | Yoshino et al. | |

FOREIGN PATENT DOCUMENTS

| | | | | |
|---|---|---|---|---|
| CN | 101784686 | A | 7/2010 | |
| CN | 102260833 | A | 11/2011 | |
| CN | 102534425 | A | 7/2012 | |
| CN | 107835865 | A | 3/2018 | |
| JP | H11302737 | A | 11/1999 | |
| JP | 2007016310 | A | 1/2007 | |
| JP | 2010070799 | A | 4/2010 | |
| JP | 2014189862 | A | 10/2014 | |
| JP | 2016041834 | A | 3/2016 | |
| JP | 2016191150 | A | 11/2016 | |
| WO | 2017169011 | A1 | 10/2017 | |
| WO | WO-2017170611 | A1 * | 10/2017 | C21D 8/02 |
| WO | 2018158854 | A1 | 9/2018 | |
| WO | 2018199062 | A1 | 11/2018 | |

OTHER PUBLICATIONS

Jun. 8, 2022, Office Action issued by the China National Intellectual Property Administration in the corresponding Chinese Patent Application No. 201980081620.3 with English language search report.

Nov. 25, 2022, Office Action issued by the Korean Intellectual Property Office in the corresponding Korean Patent Application No. 10-2021-7021082 with English language concise statement of relevance.

May 9, 2022, Office Action issued by the Canadian Intellectual Property Office in the corresponding Canadian Patent Application No. 3,122,753.

(Continued)

*Primary Examiner* — Jophy S. Koshy
(74) *Attorney, Agent, or Firm* — KENJA IP LAW PC

(57) ABSTRACT

A ferritic stainless steel sheet has a predetermined chemical composition and thickness, and has an area ratio of crystal grains of 45 μm or more in grain size of 20% or less.

4 Claims, No Drawings

(56) References Cited

OTHER PUBLICATIONS

Feb. 15, 2022, the Extended European Search Report issued by the European Patent Office in the corresponding European Patent Application No. 19896808.3.
ARMCO 409 Ni: Microalloyed Ferritic/Martensitic Stainless Steel, Alloy Digest, Dec. 1, 1996, SS-663, vol. 45, Issue 12.
Feb. 2, 2021, Notification of Reasons for Refusal issued by the Japan Patent Office in the corresponding Japanese Patent Application No. 2020-517406 with English language Concise Statement of Relevance.
Mar. 3, 2020, International Search Report issued in the International Patent Application No. PCT/JP2019/046399.

* cited by examiner

FERRITIC STAINLESS STEEL SHEET AND METHOD FOR PRODUCING SAME

TECHNICAL FIELD

The present disclosure relates to a ferritic stainless steel sheet suitable as material for flanges of exhaust system parts of automobiles, and a method for producing the same.

BACKGROUND

An exhaust gas passage of an automobile is composed of various parts (hereafter also referred to as "exhaust system parts") such as an exhaust manifold, a muffler, a catalyst, a flexible tube, a center pipe, and a front pipe.

Exhaust system parts are typically connected by fastening parts called flanges. Flanges are required to have sufficient rigidity. Accordingly, flanges are usually produced from thick (for example, thickness of 5.0 mm or more) steel sheets.

Conventionally, common steel is often used in flanges connecting exhaust system parts. However, flanges connecting parts that are exposed to high-temperature exhaust gas as in an exhaust gas recirculation (EGR) system are required to have high corrosion resistance.

In view of this, for flanges connecting exhaust system parts, the use of stainless steel sheets higher in corrosion resistance than common steel, such as ferritic stainless steel sheets having a relatively low coefficient of thermal expansion and unlikely to generate thermal stress, is studied.

As such stainless steel sheets, for example, JP 2016-191150 A (PTL 1) discloses the following: "A stainless steel sheet having excellent toughness (Charpy impact value at −40° C.: 50 J/cm$^2$ or more), containing, in mass %, C: 0.02% or less, N: 0.02% or less, Si: 0.005% to 1.0%, Ni: 0.1% to 1.0%, Mn: 0.1% to 3.0%, P: 0.04% or less, S: 0.0100% or less, Cr: 10% or more and less than 18%, and one or two selected from Ti: 0.05% to 0.30% and Nb: 0.01% to 0.50% where a total content of Ti and Nb is 8(C+N) % to 0.75%, with a balance consisting of Fe and inevitable impurities, wherein $\gamma_p$ is 70% or more, a ferrite grain size is 20 μm or less, and a martensite formation amount is 70% or less, $\gamma_p$ (%) being evaluated using the following formula (1):

$$\gamma_p = 420(\%\ C) + 470(\%\ N) + 23(\%\ Ni) + 9(\%\ Cu) + 7(\%\ Mn) - 11.5(\%\ Cr) - 11.5(\%\ Si) - 12(\%\ Mo) - 23(\%\ V) - 47(\%\ Nb) - 49(\%\ Ti) - 52(\%\ Al) + 189 \quad (1),$$

where (% X) denotes a mass ratio of each component X".

CITATION LIST

Patent Literature

PTL 1: JP 2016-191150 A

SUMMARY

Technical Problem

A flange is typically produced by subjecting a steel sheet as material (hereafter also referred to as "steel sheet for flanges") to blanking by a press and the like. Therefore, the steel sheet for flanges needs to have excellent blanking workability.

When subjecting the stainless steel sheet in PTL 1 to blanking, however, cracking tends to occur on the blanked end surface in a direction parallel to the steel sheet surface.

Thus, the ferritic stainless steel sheet in PTL 1 has a disadvantage regarding blanking workability when used as a thick steel sheet for flanges.

It could therefore be helpful to provide a thick ferritic stainless steel sheet having excellent blanking workability and excellent corrosion resistance, together with a method for producing the same.

Herein, "excellent blanking workability" denotes the following: When observing, after a hole of 10 mmφ is blanked in a steel sheet with a clearance of 12.5%, the whole circumference of the blanked end surface using an optical microscope (magnification: 200), there is no crack with a surface length of 1.0 mm or more on the blanked end surface.

Herein, "excellent corrosion resistance" denotes the following: The rusting ratio when the salt spray cycle test defined in JIS H 8502 is conducted for three cycles is 30% or less.

Solution to Problem

We closely examined the relationship between the cracking on the blanked end surface and the metallic microstructure.

Specifically, various thick ferritic stainless steel sheets of 5.2 mm to 12.9 mm in thickness were produced. A hole of 10 mmφ was blanked in each produced steel sheet with a clearance of 12.5%, and the relationship between the cracking on the blanked end surface and the metallic microstructure after the blanking was closely examined.

As a result, we learned that the grain size distribution of crystal grains in the steel sheet, specifically, the ratio of coarse crystal grains, significantly influences the blanking workability.

In detail, cracks that form during blanking tend to grow along the grain boundaries of coarse crystal grains. Accordingly, if the ratio of coarse crystal grains increases, cracks tend to form on the blanked end surface in a direction parallel to the steel sheet surface, even when the average crystal grain size in the whole metallic microstructure of the steel sheet is small.

The influence of crystal grains of 45 μm or more in grain size is particularly significant. By reducing the area ratio of crystal grains of 45 μm or more in grain size to 20% or less, excellent blanking workability can be achieved.

To reduce the area ratio of crystal grains (ferrite crystal grains) of 45 μm or more in grain size to 20% or less, it is important to:

- appropriately adjust the chemical composition, in particular, adjust the contents of Si, Mn, Cr, and Ni to appropriate ranges; and
- appropriately control the production conditions, in particular, limit the slab heating temperature to 1050° C. or more and 1250° C. or less, and, when subjecting the slab to hot rolling, limit the cumulative rolling reduction in a temperature range of $T_1$ [° C.] to $T_2$ [° C.] to 50% or more, and limit the coiling temperature to 500° C. or more.

In this way, a ferritic stainless steel sheet having excellent blanking workability even in the case where the steel sheet is thick can be obtained.

We presume the reason for this as follows:

When producing a ferritic stainless steel sheet, normally dynamic recrystallization and static recrystallization hardly occur in ferrite phase during hot rolling. Hence, recovery easily occurs about processing strain introduced into ferrite phase during hot rolling. Accordingly, the recovery continually occurs about the processing strain introduced into ferrite phase during hot rolling, and coarse ferrite elongated grains remain after the hot rolling.

As a result of the chemical composition and the production conditions being controlled as mentioned above, hot rolling is performed at a high rolling reduction in a state in which the metallic microstructure of the material to be rolled contains a large amount of austenite phase. Austenite phase develops dynamic recrystallization and/or static recrystallization during hot rolling, unlike ferrite phase.

In detail, as a result of performing rolling at a high rolling reduction in a rolling pass in the temperature range of $T_1$ [° C.] to $T_2$ [° C.] in which dynamic recrystallization and/or static recrystallization of austenite phase occurs actively, the crystal grains of austenite phase are refined. In the temperature range, the metallic microstructure of the material to be rolled is dual phase microstructure of ferrite phase and austenite phase. Additionally, as mentioned above, the crystal grains of austenite phase are refined. Thus, the different-phase interface between ferrite phase and austenite phase which serves as a barrier to crystal grain growth during hot rolling is increased, and the whole metallic microstructure of the steel sheet obtained immediately after the hot rolling is refined.

Consequently, the metallic microstructure of the whole steel sheet in the final product is refined. Specifically, the area ratio of the crystal grains of 45 μm or more in grain size which adversely affect the blanking workability is considerably reduced, and excellent blanking workability is achieved.

Here, $T_1$ [° C.] and $T_2$ [° C.] are respectively defined by the following formulas (1) and (2):

$$T_1[°\ C.]=144Ni+66Mn+885 \quad (1)$$

$$T_2[°\ C.]=91Ni+40Mn+1083 \quad (2),$$

where $T_1$ [° C.] denotes the minimum temperature for securing sufficient austenite phase, and $T_2$ [° C.] denotes the maximum temperature for securing sufficient austenite phase.

In the formulas (1) and (2), Ni and Mn are respectively Ni content (mass %) and Mn content (mass %).

The present disclosure is based on these discoveries and further studies.

We thus provide:

1. A ferritic stainless steel sheet comprising: a chemical composition containing (consisting of), in mass %, C: 0.001% to 0.020%, Si: 0.05% to 1.00%, Mn: 0.05% to 1.50%, P: 0.04% or less, S: 0.010% or less, Al: 0.001% to 0.300%, Cr: 10.0% to 13.0%, Ni: 0.65% to 1.50%, Ti: 0.15% to 0.35%, and N: 0.001% to 0.020%, with a balance consisting of Fe and inevitable impurities; an area ratio of crystal grains of 45 μm or more in grain size of 20% or less; and a thickness of 5.0 mm or more.

2. The ferritic stainless steel sheet according to 1., wherein the chemical composition further contains, in mass %, one or more selected from Cu: 0.01% to 1.00%, Mo: 0.01% to 1.00%, W: 0.01% to 0.20%, and Co: 0.01% to 0.20%.

3. The ferritic stainless steel sheet according to 1. or 2., wherein the chemical composition further contains, in mass %, one or more selected from V: 0.01% to 0.20%, Nb: 0.01% to 0.10%, and Zr: 0.01% to 0.20%.

4. The ferritic stainless steel sheet according to any of 1. to 3., wherein the chemical composition further contains, in mass %, one or more selected from B: 0.0002% to 0.0050%, REM: 0.001% to 0.100%, Mg: 0.0005% to 0.0030%, Ca: 0.0003% to 0.0050%, Sn: 0.001% to 0.500%, and Sb: 0.001% to 0.500%.

5. A method for producing the ferritic stainless steel sheet according to any of 1. to 4., the method comprising the following (a) and (b) and optionally comprising the following (c): (a) heating a slab having the chemical composition according to any of 1. to 4. to a temperature range of 1050° C. or more and 1250° C. or less; (b) subjecting the slab to hot rolling at a cumulative rolling reduction in a temperature range of $T_1$ [° C.] to $T_2$ [° C.] of 50% or more and a coiling temperature of 500° C. or more, to obtain a hot-rolled steel sheet; and (c) subjecting the hot-rolled steel sheet to hot-rolled sheet annealing in a temperature range of 600° C. or more and less than 800° C., wherein $T_1$ and $T_2$ are respectively defined by the following formulas (1) and (2):

$$T_1[°\ C.]=144Ni+66Mn+885 \quad (1)$$

$$T_2[°\ C.]=91Ni+40Mn+1083 \quad (2)$$

where Ni and Mn are respectively Ni content and Mn content in mass % in the chemical composition of the slab.

Advantageous Effect

It is thus possible to obtain a thick ferritic stainless steel sheet having excellent blanking workability and excellent corrosion resistance and suitable as material for flanges of exhaust system parts of automobiles.

DETAILED DESCRIPTION

One of the disclosed embodiments will be described below.

First, the chemical composition of a ferritic stainless steel sheet according to one of the disclosed embodiments will be described below. Although the unit in the chemical composition is "mass %", the unit is simply expressed as "%" unless otherwise noted.

C: 0.001% to 0.020%

The C content is preferably low, from the viewpoint of the workability and the corrosion resistance. In particular, if the C content is more than 0.020%, the workability and the corrosion resistance decrease greatly. Reducing the C content to less than 0.001%, however, requires lengthy refining, and causes an increase in production costs and a decrease in productivity.

The C content is therefore 0.001% or more and 0.020% or less. The C content is preferably 0.003% or more, and more preferably 0.004% or more. The C content is preferably 0.015% or less, and more preferably 0.012% or less.

Si: 0.05% to 1.00%

Si is an element useful as a deoxidizing element in steelmaking. This effect is achieved if the Si content is 0.05% or more, and is greater when the Si content is higher. If the Si content is more than 1.00%, however, it is difficult to cause sufficient austenite phase to be present during hot rolling. Consequently, the metallic microstructure in the final product is not refined sufficiently, and the desired blanking workability cannot be achieved.

The Si content is therefore 0.05% or more and 1.00% or less. The Si content is preferably 0.10% or more, and more preferably 0.20% or more. The Si content is preferably 0.60% or less, and more preferably 0.50% or less. The Si content is further preferably 0.40% or less.

Mn: 0.05% to 1.50%

Mn has an effect of increasing the amount of austenite phase during hot rolling to improve the blanking workability. This effect is achieved if the Mn content is 0.05% or more. If the Mn content is more than 1.50%, precipitation of MnS which becomes an initiation point of corrosion is facilitated, and the corrosion resistance decreases.

The Mn content is therefore 0.05% or more and 1.50% or less. The Mn content is preferably 0.20% or more, and more preferably 0.30% or more. The Mn content is preferably 1.20% or less, and more preferably 1.00% or less.

P: 0.04% or Less

P is an element inevitably contained in the steel, and is detrimental to the corrosion resistance and the workability. Accordingly, the P content is preferably reduced as much as possible. In particular, if the P content is more than 0.04%, the workability decreases considerably due to solid solution strengthening.

The P content is therefore 0.04% or less. The P content is preferably 0.03% or less.

No lower limit is placed on the P content. However, since excessive dephosphorization leads to increased costs, the lower limit of the P content is preferably 0.005%.

S: 0.010% or Less

S is an element inevitably contained in the steel and is detrimental to the corrosion resistance and the workability, as with P. Accordingly, the S content is preferably reduced as much as possible. In particular, if the S content is more than 0.010%, the corrosion resistance decreases considerably.

The S content is therefore 0.010% or less. The S content is preferably 0.008% or less, and more preferably 0.003% or less.

No lower limit is placed on the S content. However, since excessive desulfurization leads to increased costs, the lower limit of the S content is preferably 0.0005%.

Al: 0.001% to 0.300%

Al is an element useful as a deoxidizer. This effect is achieved if the Al content is 0.001% or more. If the Al content is more than 0.300%, it is difficult to cause sufficient austenite phase to be present during hot rolling. Consequently, the metallic microstructure in the final product is not refined sufficiently, and the desired blanking workability cannot be achieved.

The Al content is therefore 0.001% or more and 0.300% or less. The Al content is preferably 0.005% or more, and more preferably 0.010% or more. The Al content is preferably 0.100% or less, and more preferably 0.050% or less.

Cr: 10.0% to 13.0%

Cr is an important element for ensuring the corrosion resistance. If the Cr content is less than 10.0%, the corrosion resistance required for flanges of exhaust system parts of automobiles cannot be achieved. If the Cr content is more than 13.0%, it is difficult to cause sufficient austenite phase to be present during hot rolling. Consequently, the metallic microstructure in the final product is not refined sufficiently, and the desired blanking workability cannot be achieved.

The Cr content is therefore 10.0% or more and 13.0% or less. The Cr content is preferably 10.5% or more, and more preferably 11.0% or more. The Cr content is preferably 12.5% or less, and more preferably 12.0% or less.

Ni: 0.65% to 1.50%

Ni is an austenite forming element, and has an effect of increasing the amount of austenite phase formed during hot rolling to refine the metallic microstructure in the final product and improve the blanking workability. This effect is achieved if the Ni content is 0.65% or more. If the Ni content is more than 1.50%, the blanking workability improving effect by the refinement of ferrite crystal grains is saturated. In addition, the steel sheet becomes excessively hard due to solid solution strengthening, and the workability decreases. Furthermore, stress corrosion cracking tends to occur.

The Ni content is therefore 0.65% or more and 1.50% or less. The Ni content is preferably 0.70% or more, and more preferably 0.75% or more. The Ni content is preferably 1.20% or less, and more preferably 1.00% or less.

Ti: 0.15% to 0.35%

Ti has an effect of preferentially combining with C and N and suppressing a decrease in corrosion resistance caused by sensitization due to precipitation of Cr carbonitride. This effect is achieved if the Ti content is 0.15% or more. If the Ti content is more than 0.35%, the formation of coarse TiN causes a decrease in toughness, and the desired blanking workability cannot be achieved.

The Ti content is therefore 0.15% or more and 0.35% or less. The Ti content is preferably 0.20% or more. The Ti content is preferably 0.30% or less.

N: 0.001% to 0.020%

The N content is preferably low, from the viewpoint of the workability and the corrosion resistance. In particular, if the N content is more than 0.020%, the workability and the corrosion resistance decrease greatly. Reducing the N content to less than 0.001%, however, requires lengthy refining, and causes an increase in production costs and a decrease in productivity.

The N content is therefore 0.001% or more and 0.020% or less. The N content is preferably 0.003% or more, and more preferably 0.004% or more. The N content is preferably 0.015% or less, and more preferably 0.012% or less.

While the basic components of the chemical composition have been described above, the chemical composition may optionally further contain, in addition to the basic components, one or more selected from Cu: 0.01% to 1.00%, Mo: 0.01% to 1.00%, W: 0.01% to 0.20%, and Co: 0.01% to 0.20%, one or more selected from V: 0.01% to 0.20%, Nb: 0.01% to 0.10%, and Zr: 0.01% to 0.20%, and one or more selected from B: 0.0002% to 0.0050%, REM: 0.001% to 0.100%, Mg: 0.0005% to 0.0030%, Ca: 0.0003% to 0.0050%, Sn: 0.001% to 0.500%, and Sb: 0.001% to 0.500%.

Cu: 0.01% to 1.00%

Cu is an element effective in improving the corrosion resistance in an aqueous solution and the corrosion resistance in the case where weakly acidic water droplets adhere to the steel sheet. Cu also has an effect of increasing the amount of austenite phase during hot rolling. These effects are achieved if the Cu content is 0.01% or more, and is greater when the Cu content is higher. If the Cu content is more than 1.00%, however, the hot workability decreases and surface defects occur in some cases. Moreover, descaling after annealing may be difficult.

Accordingly, in the case of containing Cu, the Cu content is 0.01% or more and 1.00% or less. The Cu content is preferably 0.10% or more. The Cu content is preferably 0.50% or less.

Mo: 0.01% to 1.00%

Mo is an element that improves the corrosion resistance of the stainless steel. This effect is achieved if the Mo content is 0.01% or more, and is greater when the Mo content is higher. If the Mo content is more than 1.00%, however, the amount of austenite phase present during hot rolling decreases and sufficient blanking workability cannot be achieved in some cases.

Accordingly, in the case of containing Mo, the Mo content is 0.01% or more and 1.00% or less. The Mo content is preferably 0.10% or more, and more preferably 0.30% or more. The Mo content is preferably 0.80% or less, and more preferably 0.50% or less.

W: 0.01% to 0.20%

W has an effect of improving the strength at high temperature. This effect is achieved if the W content is 0.01% or more. If the W content is more than 0.20%, the strength at high temperature increases excessively and the hot rolling manufacturability decreases due to an increased rolling load or the like in some cases.

Accordingly, in the case of containing W, the W content is 0.01% or more and 0.20% or less. The W content is preferably 0.05% or more. The W content is preferably 0.15% or less.

Co: 0.01% to 0.20%

Co has an effect of improving the strength at high temperature. This effect is achieved if the Co content is 0.01% or more. If the Co content is more than 0.20%, the strength at high temperature increases excessively and the hot rolling manufacturability decreases due to an increased rolling load or the like in some cases.

Accordingly, in the case of containing Co, the Co content is 0.01% or more and 0.20% or less.

V: 0.01% to 0.20%

V forms carbonitride with C and N and suppresses sensitization during welding to improve the corrosion resistance of a weld. This effect is achieved if the V content is 0.01% or more. If the V content is more than 0.20%, the workability may decrease considerably.

Accordingly, in the case of containing V, the V content is 0.01% or more and 0.20% or less. The V content is preferably 0.02% or more. The V content is preferably 0.10% or less.

Nb: 0.01% to 0.10%

Nb has an effect of refining crystal grains. This effect is achieved if the Nb content is 0.01% or more. Nb is also an element that increases the recrystallization temperature. Hence, if the Nb content is more than 0.10%, the annealing temperature necessary for sufficient recrystallization in hot-rolled sheet annealing is excessively high. Consequently, the desired fine metallic microstructure cannot be obtained in the final product in some cases.

Accordingly, in the case of containing Nb, the Nb content is 0.01% or more and 0.10% or less. The Nb content is preferably 0.05% or less.

Zr: 0.01% to 0.20%

Zr has an effect of combining with C and N and suppressing sensitization. This effect is achieved if the Zr content is 0.01% or more. If the Zr content is more than 0.20%, the workability may decrease considerably.

Accordingly, in the case of containing Zr, the Zr content is 0.01% or more and 0.20% or less. The Zr content is preferably 0.10% or less.

B: 0.0002% to 0.0050%

B is an element effective in improving the resistance to secondary working brittleness after deep drawing. This effect is achieved if the B content is 0.0002% or more. If the B content is more than 0.0050%, the workability may decrease.

Accordingly, in the case of containing B, the B content is 0.0002% or more and 0.0050% or less. The B content is preferably 0.0030% or less.

REM: 0.001% to 0.100%

REM (rare earth metals) has an effect of improving the oxidation resistance, and suppresses the formation of an oxide layer of a weld (welding temper color) to suppress the formation of a Cr-depleted region directly below the oxide layer. This effect is achieved if the REM content is 0.001% or more. If the REM content is more than 0.100%, the hot rolling manufacturability may decrease.

Accordingly, in the case of containing REM, the REM content is 0.001% or more and 0.100% or less. The REM content is preferably 0.050% or less.

Mg: 0.0005% to 0.0030%

In stainless steel containing Ti, there is a possibility that coarse Ti carbonitride forms and the toughness decreases. Mg has an effect of suppressing the formation of coarse Ti carbonitride. This effect is achieved if the Mg content is 0.0005% or more. If the Mg content is more than 0.0030%, the surface characteristics of the steel may degrade.

Accordingly, in the case of containing Mg, the Mg content is 0.0005% or more and 0.0030% or less. The Mg content is preferably 0.0010% or more. The Mg content is preferably 0.0020% or less.

Ca: 0.0003% to 0.0050%

Ca is an element effective in preventing nozzle blockage caused by the crystallization of Ti type inclusions which tend to form during continuous casting. This effect is achieved if the Ca content is 0.0003% or more. If the Ca content is more than 0.0050%, the corrosion resistance may decrease due to the formation of CaS.

Accordingly, in the case of containing Ca, the Ca content is 0.0003% or more and 0.0050% or less. The Ca content is preferably 0.0004% or more, and more preferably 0.0005% or more. The Ca content is preferably 0.0040% or less, and more preferably 0.0030% or less.

Sn: 0.001% to 0.500%

Sn has an effect of improving the corrosion resistance and the strength at high temperature. This effect is achieved if the Sn content is 0.001% or more. If the Sn content is more than 0.500%, the hot workability may decrease.

Accordingly, in the case of containing Sn, the Sn content is 0.001% or more and 0.500% or less.

Sb: 0.001% to 0.500%

Sb has an effect of segregating to grain boundaries and increasing the strength at high temperature. This effect is achieved if the Sb content is 0.001% or more. If the Sb content is more than 0.500%, weld cracks may occur.

Accordingly, in the case of containing Sb, the Sb content is 0.001% or more and 0.500% or less.

The components other than those described above consist of Fe and inevitable impurities. Examples of the inevitable impurities include O (oxygen), and an O content of 0.01% or less is allowable.

The metallic microstructure of the ferritic stainless steel sheet according to one of the disclosed embodiments will be described below.

The metallic microstructure of the ferritic stainless steel sheet according to one of the disclosed embodiments has ferrite phase of 97% or more in volume ratio. The metallic microstructure may have ferrite phase of 100% in volume ratio, i.e. ferrite single phase.

The volume ratio of residual microstructures other than ferrite phase is 3% or less. Examples of the residual microstructures include martensite phase. Herein, precipitates and inclusions are not included in the volume ratio of the metallic microstructure (i.e. are not counted in the volume ratio of the metallic microstructure).

The volume ratio of ferrite phase is calculated as follows: A sample for cross-sectional observation is produced from a stainless steel sheet, and etched with a saturated picric acid chlorine solution. Observation is then performed using an optical microscope for 10 observation fields with 100 magnification. After distinguishing martensite phase and ferrite phase based on microstructure shape, the volume ratio of ferrite phase is determined by image processing, and the average value thereof is calculated.

The volume ratio of the residual microstructures is calculated by subtracting the volume ratio of ferrite phase from 100%.

In the ferritic stainless steel sheet according to one of the disclosed embodiments, it is important to reduce the area ratio of crystal grains of 45 μm or more in grain size to 20% or less in a state in which the microstructure is substantially ferrite single phase as mentioned above.

Area Ratio of Crystal Grains of 45 μm or More in Grain Size: 20% or Less

As mentioned earlier, cracks that form during blanking tend to grow along coarse crystal grains. Accordingly, if the ratio of coarse crystal grains increases, cracks tend to form on the blanked end surface even when the average grain size of crystal grains contained in the whole steel sheet is small.

In particular, if the area ratio of coarse ferrite crystal grains of 45 μm or more in grain size is more than 20%, the blanking workability decreases considerably.

The area ratio of crystal grains of 45 μm or more in grain size is therefore 20% or less. The area ratio of crystal grains of 45 μm or more in grain size is preferably 15% or less. No lower limit is placed on the area ratio, and the area ratio may be 0%.

The reason that crystal grains of 45 μm or more in grain size are subjected to control is because the influence of the crystal grains of 45 μm or more in grain size on the blanking workability is particularly significant. The crystal grains of 45 μm or more in grain size are all ferrite crystal grains.

The area ratio of crystal grains of 45 μm or more in grain size is calculated as follows:

For a region of 400 μm in the rolling direction and 800 μm in the thickness direction at a position of ¼ of the thickness in a section (L section) parallel to the rolling direction of the steel sheet (the position of ¼ of the thickness being the center in the thickness direction), crystal orientation analysis by electron back scattering diffraction (EBSD) is conducted. Boundaries with a crystal orientation difference of 15° or more are defined as crystal grain boundaries, the area of each crystal grain is calculated, and the equivalent circular diameter of the crystal grain is calculated from the area (the area of the crystal grain is expressed by [the area of the crystal grain]=π×([the equivalent circular diameter of the crystal grain]/2)$^2$).

The calculated equivalent circular diameter is taken to be the grain size of the crystal grain, and crystal grains of 45 μm or more in grain size are specified. The area ratio of the crystal grains of 45 μm or more in grain size is calculated according to the following formula:

[the area ratio (%) of the crystal grains of 45 μm or more in grain size]=([the total area of the crystal grains of 45 μm or more in grain size]/[the area of the measurement region])×100.

Thickness: 5.0 mm or More

The thickness of the ferritic stainless steel sheet is 5.0 mm or more. The thickness is preferably 7.0 mm or more.

If the thickness is excessively large, the amount of rolling processing strain applied to a thickness center part during hot rolling decreases. Consequently, even when the hot rolling is performed under predetermined conditions, coarse grains remain in the thickness center part and the desired metallic microstructure cannot be obtained in the final product in some cases. Accordingly, the thickness of the ferritic stainless steel sheet is preferably 15.0 mm or less. The thickness is more preferably 13.0 mm or less.

A method for producing a ferritic stainless steel sheet according to one of the disclosed embodiments will be described below.

First, molten steel having the foregoing chemical composition is obtained by steelmaking using a known method such as a converter, an electric heating furnace, or a vacuum melting furnace, and made into a steel material (hereafter also referred to as "slab") by continuous casting or ingot casting and blooming.

Slab Heating Temperature: 1050° C. to 1250° C.

The obtained slab is then heated to 1050° C. to 1250° C. and subjected to hot rolling.

If the slab heating temperature is less than 1050° C., sufficient austenite phase does not form in the metallic microstructure of the slab, making it impossible to cause sufficient austenite phase to be present during a rolling pass in a temperature range of $T_1$ [° C.] to $T_2$ [° C.] in the subsequent hot rolling. Consequently, even when the hot rolling is performed under the predetermined conditions, the desired metallic microstructure cannot be obtained in the final product.

If the slab heating temperature is more than 1250° C., the metallic microstructure of the slab is mainly composed of δ-ferrite phase, making it impossible to form sufficient austenite phase in the rolling pass in the temperature range of $T_1$ [° C.] to $T_2$ [° C.] in the subsequent hot rolling. Consequently, even when the hot rolling is performed under the predetermined conditions, the desired metallic microstructure cannot be obtained in the final product.

The slab heating temperature is therefore 1050° C. or more and 1250° C. or less.

The heating time is preferably 1 hr to 24 hr. In the case where the cast slab is in a temperature range of 1050° C. or more and 1250° C. or less before hot rolling the slab, the slab may be directly subjected to the rolling.

Cumulative Rolling Reduction in Temperature Range of $T_1$ [° C.] to $T_2$ [° C.]: 50% or More In the hot rolling, it is important to perform rolling at a high rolling reduction in a state in which the metallic microstructure of the material to be rolled contains a large amount of austenite phase, thus causing dynamic recrystallization and/or static recrystallization in the austenite phase. Hence, the cumulative rolling reduction in the temperature range of $T_1$ [° C.] to $T_2$ [° C.] is 50% or more.

In detail, as a result of performing rolling at a high rolling reduction in a state in which the metallic microstructure of the material to be rolled contains a large amount of austenite phase, dynamic recrystallization and/or static recrystallization occurs. Consequently, the metallic microstructure in the final product is refined, and excellent blanking workability is achieved.

If the rolling is performed at less than $T_1$ [° C.], the amount of austenite phase present is insufficient in the metallic microstructure of the material to be rolled. Thus, the rolling at less than $T_1$ [° C.] contributes little to the refined metallic microstructure in the final product. If the rolling is performed at more than $T_2$ [° C.], too, the amount of austenite phase present is insufficient in the metallic microstructure of the material to be rolled.

Hence, the rolling at more than $T_2$ [° C.] contributes little to the refined metallic microstructure in the final product. It is therefore very important to increase the cumulative rolling reduction in the temperature range of $T_1$ [° C.] to $T_2$ [° C.].

If the cumulative rolling reduction in the temperature range of $T_1$ [° C.] to $T_2$ [° C.] is less than 50%, the refinement effect by the dynamic recrystallization and/or static recrystallization of austenite phase decreases, and the metallic microstructure in the final product cannot be refined sufficiently.

The cumulative rolling reduction in the temperature range of $T_1$ [° C.] to $T_2$ [° C.] is therefore 50% or more. The cumulative rolling reduction is preferably 60% or more, and more preferably 65% or more. No upper limit is placed on the cumulative rolling reduction in the temperature range of $T_1$ to $T_2$. However, if the cumulative rolling reduction in the temperature range is excessively high, the rolling load increases and the productivity decreases. Moreover, there is a possibility of surface roughening after the rolling. Accordingly, the cumulative rolling reduction in the temperature range of $T_1$ to $T_2$ is preferably 75% or less.

The cumulative rolling reduction in the temperature range of $T_1$ to $T_2$ is defined by the following formula:

[the cumulative rolling reduction (%) in the temperature range of $T_1$ to $T_2$]=[the total thickness reduction quantity (mm) in the rolling passes whose rolling start temperature is in the range of $T_1$ to $T_2$]/[the thickness (mm) at the start of the first rolling pass whose rolling start temperature is in the range of $T_1$ to $T_2$]×100.

$T_1$ and $T_2$ are respectively defined by the following formulas (1) and (2):

$$T_1[°\text{ C.}]=144\text{Ni}+66\text{Mn}+885 \quad (1)$$

$$T_2[°\text{ C.}]=91\text{Ni}+40\text{Mn}+1083 \quad (2),$$

where Ni and Mn are respectively the Ni content (mass %) and the Mn content (mass %) in the chemical composition of the slab described above.

Coiling Temperature: 500° C. or More

If the coiling temperature is less than 500° C., austenite phase transforms into martensite phase, causing the metallic microstructure of the final product to be dual phase microstructure of ferrite phase and martensite. As a result, the blanking workability degrades. The coiling temperature is therefore 500° C. or more. No upper limit is placed on the coiling temperature, but the coiling temperature is preferably 800° C. or less.

The number of rolling passes (the total number of passes) in the hot rolling is typically about 10 to 14.

The total rolling reduction in the hot rolling is typically more than 90%.

The rolling finish temperature (the rolling finish temperature of the final pass) in the hot rolling is not limited. However, since there is a possibility of a surface defect if the rolling finish temperature is excessively low, the rolling finish temperature is preferably 750° C. or more.

The hot-rolled steel sheet obtained as a result of the hot rolling is optionally subjected to hot-rolled sheet annealing. In the case of performing the hot-rolled sheet annealing, the hot-rolled sheet annealing temperature needs to be 600° C. or more and less than 800° C.

Hot-Rolled Sheet Annealing Temperature: 600° C. or More and Less than 800° C.

The hot-rolled sheet annealing temperature is 600° C. or more, from the viewpoint of sufficiently recrystallizing the rolled microstructure remaining in the hot rolling. If the hot-rolled sheet annealing temperature is 800° C. or more, recrystallized grains coarsen, and the desired metallic microstructure cannot be obtained in the final product.

The hot-rolled sheet annealing temperature is therefore 600° C. or more and less than 800° C. The hot-rolled sheet annealing temperature is preferably 600° C. or more. The hot-rolled sheet annealing temperature is preferably 750° C. or less.

The annealing time in the hot-rolled sheet annealing is not limited, but is preferably 1 min to 20 hr.

The hot-rolled steel sheet (including the hot-rolled and annealed steel sheet) obtained in the above-described manner may be subjected to descaling such as shot blasting or pickling. Moreover, grinding, polishing, and the like may be performed to improve the surface characteristics. After this, cold rolling and cold-rolled sheet annealing may be performed.

The conditions in these processes are not limited, and may be in accordance with conventional methods.

EXAMPLES

Examples according to one of the disclosed embodiments will be described below.

Using each of the respective steels having the chemical compositions (the balance consisting of Fe and inevitable impurities) listed in Table 1, 100 kg of a steel ingot was produced in a vacuum melting furnace, and a slab with a thickness of 200 mm was obtained from the steel ingot by cutting work. The slab was then heated for 1 hr under the conditions listed in Table 2, and subsequently subjected to hot rolling of eleven passes under the conditions listed in Table 2, to obtain a hot-rolled steel sheet.

In the fourth and subsequent passes, the temperature was below $T_1$ [° C.] in all cases. Accordingly, the finish thickness in the fourth pass and the rolling start temperature and the finish thickness in each of the subsequent passes are omitted in the table. The thickness was measured at a center position of the steel sheet (i.e. a position of the center of the steel sheet in the rolling direction and in the transverse direction), using a micro gauge. Coiling was simulated by holding the steel sheet for 1 hr at the coiling temperature in Table 2 and then furnace cooling the steel sheet. Before holding the steel sheet at the coiling temperature, hot shearing was performed to size the steel sheet so as to be insertable into the furnace.

Some of the hot-rolled steel sheets were further subjected to hot-rolled sheet annealing under the conditions listed in Table 2. The holding time (annealing time) in the hot-rolled sheet annealing was 8 hr in all cases, with furnace cooling being performed after the holding.

For each obtained steel sheet, the metallic microstructure was identified by the above-described method. As a result, the metallic microstructure of each steel sheet other than No. 30 had ferrite phase of 97% or more in volume ratio. The metallic microstructure of the steel sheet of No. 30 had dual phase microstructure composed of ferrite phase of 62% in volume ratio and martensite phase of 38% in volume ratio.

Following this, the area ratio of crystal grains of 45 μm or more in grain size was calculated by the above-described method. The results are listed in Table 2.

Further, (1) the evaluation of the blanking workability and (2) the evaluation of the corrosion resistance were conducted as follows. The evaluation results are listed in Table 2.

(1) Evaluation of Blanking Workability

From a transverse center part (i.e. a width center part) of each obtained steel sheet, a test piece of 50 mm×50 mm was collected (so that a transverse center position of the steel sheet would be a center position of the test piece in the transverse direction), and a hole of 10 mmφ was blanked in the test piece with a clearance of 12.5%.

Specifically, the test piece was subjected to blanking so that a hole of 10 mmφ (tolerance: ±0.1 mm) would be formed in a center part of the test piece, using a crank press machine including an upper die (punch) having a lightening cylindrical blade of 10 mm in diameter and a lower die (die) having a hole of 10 mm or more in diameter. Five such test pieces were produced for each steel sheet. The blanking was performed with the diameter of the hole of the lower die being selected according to the thickness of the test piece so that the clearance between the upper die and the lower die would be 12.5%. The clearance C [%] is expressed by the following formula (3):

$$C=(Dd-Dp)/(2\times t)\times 100 \quad (3),$$

where Dd [mm] is the diameter (inner diameter) of the hole of the lower die (die), Dp [mm] is the diameter of the upper die (punch), and t [mm] is the thickness of the test piece.

After this, the test piece was cut in a direction of 45° and a direction of 135° with respect to the rolling direction so as to pass through the center of the blanked hole, to divide the test piece into quarters.

The blanked end surface of the test piece divided into quarters was observed over the whole circumference using an optical microscope (magnification: 200). In the case where no crack with a surface length of 1.0 mm or more was observed on the blanked end surface of all five test pieces, the blanking workability was evaluated as "pass". In the case where a crack with a surface length of 1.0 mm or more was observed on the blanked end surface of at least one test piece, the blanking workability was evaluated as "fail".

(2) Evaluation of Corrosion Resistance

From each obtained steel sheet, a test piece of 60 mm×80 mm was collected, and its surface was polished for finish using #600 emery paper. Subsequently, the end surface part and the back surface were sealed, and the test piece was subjected to the salt spray cycle test defined in JIS H 8502.

The salt spray cycle test was conducted for three cycles, where one cycle is made up of salt spray (5 mass % NaCl aqueous solution, 35° C., spray for 2 hr)→dry (60° C., 4 hr, relative humidity: 40%)→wet (50° C., 2 hr, relative humidity≥95%).

After conducting the salt spray cycle test for three cycles, the surface of the test piece was photographed, and the rusting area on the surface of the test piece was measured through image analysis.

The ratio of the measured rusting area to the area of the measurement target region (=([the measured rusting area]/[the area of the measurement target region])×100[%]) was then calculated and taken to be the rusting ratio, and the corrosion resistance was evaluated under the following criteria:

"excellent": rusting ratio of 10% or less

"good": rusting ratio of more than 10% and 30% or less

"poor": rusting ratio of more than 30%.

The measurement target region is a region of the test piece surface except an outer peripheral part of 15 mm. The rusting area is the total area of the rusting part and the flow rust part.

TABLE 1

| Steel | Chemical composition (mass %) | | | | | | | | | | | |
|---|---|---|---|---|---|---|---|---|---|---|---|---|
| ID | C | Si | Mn | P | S | Al | Cr | Ni | Ti | N | Others | Remarks |
| A1a | 0.007 | 0.28 | 0.35 | 0.03 | 0.002 | 0.051 | 11.4 | 0.85 | 0.25 | 0.007 | — | Conforming steel |
| A1b | 0.006 | 0.28 | 0.36 | 0.03 | 0.002 | 0.049 | 11.4 | 0.86 | 0.24 | 0.008 | — | Conforming steel |
| A1e | 0.007 | 0.29 | 0.35 | 0.02 | 0.002 | 0.047 | 11.3 | 0.82 | 0.25 | 0.007 | — | Conforming steel |
| A1d | 0.007 | 0.26 | 0.34 | 0.03 | 0.003 | 0.052 | 11.5 | 0.87 | 0.26 | 0.009 | — | Conforming steel |
| A1e | 0.006 | 0.28 | 0.34 | 0.02 | 0.001 | 0.043 | 11.4 | 0.85 | 0.26 | 0.007 | — | Conforming steel |
| A1f | 0.007 | 0.28 | 0.35 | 0.03 | 0.002 | 0.055 | 11.1 | 0.84 | 0.27 | 0.008 | — | Conforming steel |
| A1g | 0.007 | 0.27 | 0.36 | 0.02 | 0.002 | 0.050 | 11.6 | 0.88 | 0.24 | 0.007 | — | Conforming steel |
| A1h | 0.006 | 0.28 | 0.34 | 0.03 | 0.001 | 0.048 | 11.4 | 0.86 | 0.28 | 0.009 | — | Conforming steel |
| A1i | 0.008 | 0.29 | 0.35 | 0.03 | 0.002 | 0.054 | 11.4 | 0.84 | 0.26 | 0.008 | — | Conforming steel |
| A1j | 0.007 | 0.27 | 0.37 | 0.03 | 0.002 | 0.056 | 11.5 | 0.87 | 0.24 | 0.007 | — | Conforming steel |
| A2 | 0.009 | 0.24 | 0.31 | 0.01 | 0.007 | 0.041 | 11.7 | 1.43 | 0.26 | 0.012 | — | Conforming steel |
| A3 | 0.007 | 0.24 | 0.33 | 0.03 | 0.005 | 0.073 | 11.3 | 0.96 | 0.24 | 0.007 | — | Conforming steel |
| A4 | 0.011 | 0.18 | 0.44 | 0.02 | 0.007 | 0.012 | 11.4 | 0.66 | 0.21 | 0.011 | — | Conforming steel |
| A5 | 0.004 | 0.20 | 1.45 | 0.02 | 0.001 | 0.030 | 11.1 | 0.92 | 0.26 | 0.010 | — | Conforming steel |
| A6 | 0.009 | 0.95 | 0.66 | 0.03 | 0.002 | 0.021 | 10.8 | 0.84 | 0.21 | 0.009 | — | Conforming steel |
| A7 | 0.014 | 0.18 | 0.38 | 0.02 | 0.002 | 0.038 | 12.7 | 0.95 | 0.25 | 0.012 | — | Conforming steel |
| A8 | 0.005 | 0.15 | 0.76 | 0.04 | 0.002 | 0.008 | 10.3 | 0.76 | 0.19 | 0.012 | — | Conforming steel |
| A9 | 0.007 | 0.28 | 0.45 | 0.02 | 0.005 | 0.054 | 11.4 | 0.81 | 0.33 | 0.009 | Mg: 0.0014, Sn: 0.012, Sb: 0.008 | Conforming steel |
| A10 | 0.011 | 0.23 | 0.48 | 0.01 | 0.004 | 0.104 | 11.6 | 0.94 | 0.16 | 0.009 | W: 0.09, Nb: 0.05, REM: 0.040 | Conforming steel |
| A11 | 0.007 | 0.26 | 0.37 | 0.03 | 0.006 | 0.073 | 11.5 | 0.80 | 0.25 | 0.009 | Cu: 0.94 | Conforming steel |
| A12 | 0.006 | 0.14 | 0.17 | 0.02 | 0.002 | 0.024 | 11.1 | 0.89 | 0.20 | 0.008 | Mo: 0.92 | Conforming steel |
| A13 | 0.006 | 0.28 | 0.21 | 0.02 | 0.004 | 0.062 | 11.4 | 0.83 | 0.27 | 0.006 | Cu: 0.04, Mo: 0.04, V: 0.02, B: 0.0003, Ca: 0.0009 | Conforming steel |
| A14 | 0.008 | 0.15 | 0.62 | 0.01 | 0.007 | 0.094 | 10.9 | 0.88 | 0.22 | 0.008 | B: 0.0028 | Conforming steel |
| A15 | 0.009 | 0.20 | 0.49 | 0.04 | 0.005 | 0.031 | 11.6 | 0.81 | 0.24 | 0.008 | V: 0.12 | Conforming steel |
| A16 | 0.008 | 0.20 | 0.85 | 0.03 | 0.002 | 0.039 | 11.6 | 0.86 | 0.27 | 0.007 | Co: 0.16, Zr: 0.08 | Conforming steel |
| B1 | 0.010 | 0.24 | 0.41 | 0.03 | 0.008 | 0.033 | 9.5 | 0.68 | 0.27 | 0.012 | — | Comparative steel |
| B2 | 0.009 | 0.20 | 0.80 | 0.02 | 0.004 | 0.040 | 11.1 | 0.61 | 0.22 | 0.008 | — | Comparative steel |
| B3 | 0.009 | 0.19 | 0.44 | 0.02 | 0.005 | 0.058 | 13.5 | 1.42 | 0.30 | 0.009 | — | Comparative steel |
| B4 | 0.008 | 1.09 | 0.41 | 0.03 | 0.003 | 0.054 | 11.4 | 0.91 | 0.21 | 0.007 | — | Comparative steel |

TABLE 1-continued

| Steel ID | Chemical composition (mass %) C | Si | Mn | P | S | Al | Cr | Ni | Ti | N | Others | Remarks |
|---|---|---|---|---|---|---|---|---|---|---|---|---|
| B5 | 0.009 | 0.31 | 1.62 | 0.02 | 0.008 | 0.043 | 10.9 | 0.75 | 0.24 | 0.006 | — | Comparative steel |
| A17 | 0.018 | 0.34 | 0.31 | 0.01 | 0.003 | 0.031 | 11.5 | 0.84 | 0.31 | 0.008 | — | Conforming steel |
| A18 | 0.010 | 0.22 | 0.35 | 0.02 | 0.002 | 0.260 | 11.1 | 0.86 | 0.20 | 0.008 | — | Conforming steel |
| A19 | 0.007 | 0.28 | 0.37 | 0.03 | 0.002 | 0.051 | 11.6 | 0.88 | 0.26 | 0.006 | Ca: 0.0044 | Conforming steel |
| A20 | 0.008 | 0.26 | 0.33 | 0.02 | 0.002 | 0.040 | 11.4 | 0.83 | 0.24 | 0.007 | Ca: 0.0036, V: 0.09 | Conforming steel |

Underlines indicate outside appropriate range.

TABLE 2

| No. | Steel ID | Slab heating temperature [° C.] | Slab thickness (at start of first pass of hot rolling) [mm] | Hot rolling conditions: First pass: First pass start temperature [° C.] | First pass: First pass finish thickness [mm] | Second pass: Second pass start temperature [° C.] | Second pass: Second pass finish thickness [mm] | Third pass: Third pass start temperature [° C.] | Third pass: Third pass finish thickness [mm] | Fourth pass: Fourth pass start temperature [° C.] | Remarks |
|---|---|---|---|---|---|---|---|---|---|---|---|
| 1 | A1a | 1109 | 200 | 1100 | 150 | 1065 | 100 | 1035 | 69 | 1025 | Example |
| 2 | A1a | 1109 | 200 | 1100 | 150 | 1065 | 100 | 1035 | 69 | 1025 | Example |
| 3 | A1a | 1109 | 200 | 1100 | 150 | 1065 | 100 | 1035 | 69 | 1025 | Example |
| 4 | A1b | 1109 | 200 | 1100 | 149 | 1065 | 99 | 1035 | 70 | 1025 | Example |
| 5 | A2 | 1149 | 200 | 1137 | 149 | 1125 | 101 | 1113 | 70 | 1100 | Example |
| 6 | A3 | 1102 | 200 | 1091 | 151 | 1069 | 99 | 1048 | 70 | 1031 | Example |
| 7 | A4 | 1103 | 200 | 1092 | 149 | 1051 | 99 | 1011 | 70 | 995 | Example |
| 8 | A5 | 1154 | 200 | 1145 | 152 | 1129 | 99 | 1116 | 69 | 1102 | Example |
| 9 | A6 | 1107 | 200 | 1098 | 149 | 1073 | 100 | 1051 | 70 | 1042 | Example |
| 10 | A7 | 1109 | 200 | 1098 | 125 | 1067 | 69 | 1037 | 60 | 1012 | Example |
| 11 | A8 | 1108 | 200 | 1097 | 148 | 1071 | 100 | 1046 | 70 | 1032 | Example |
| 12 | A9 | 1105 | 200 | 1092 | 148 | 1063 | 101 | 1033 | 70 | 1020 | Example |
| 13 | A10 | 1100 | 200 | 1089 | 149 | 1071 | 100 | 1054 | 69 | 1044 | Example |
| 14 | A11 | 1109 | 200 | 1094 | 152 | 1062 | 101 | 1027 | 70 | 1016 | Example |
| 15 | A12 | 1107 | 200 | 1093 | 148 | 1061 | 102 | 1027 | 70 | 1012 | Example |
| 16 | A13 | 1102 | 200 | 1091 | 151 | 1055 | 100 | 1020 | 68 | 1007 | Example |
| 17 | A14 | 1107 | 200 | 1090 | 150 | 1075 | 102 | 1055 | 70 | 1040 | Example |
| 18 | A15 | 1108 | 200 | 1091 | 150 | 1066 | 100 | 1036 | 69 | 1021 | Example |

| No. | Steel ID | Hot rolling conditions: $T_1$ [° C.] | $T_2$ [° C.] | Rolling pass in temperature range of $T_1$ to $T_2$ | Cumulative rolling reduction in temperature range of $T_1$ to $T_2$ [%] | Rolling finish temperature [° C.] | Coiling temperature [° C.] | Hot-rolled sheet annealing temperature [° C.] | Thickness after completion of hot rolling [mm] | Remarks |
|---|---|---|---|---|---|---|---|---|---|---|
| 1 | A1a | 1031 | 1174 | First to third passes | 66 | 855 | 698 | No annealing | 8.0 | Example |
| 2 | A1a | 1031 | 1174 | First to third passes | 66 | 855 | 698 | 795 | 8.0 | Example |
| 3 | A1a | 1031 | 1174 | First to third passes | 66 | 855 | 698 | 610 | 8.0 | Example |
| 4 | A1b | 1031 | 1174 | First to third passes | 65 | 870 | 698 | 670 | 8.2 | Example |
| 5 | A2 | 1111 | 1226 | First to third passes | 65 | 864 | 683 | No annealing | 8.1 | Example |
| 6 | A3 | 1045 | 1184 | First to third passes | 65 | 856 | 700 | No annealing | 8.2 | Example |
| 7 | A4 | 1009 | 1161 | First to third passes | 65 | 868 | 623 | No annealing | 8.1 | Example |
| 8 | A5 | 1113 | 1225 | First to third passes | 66 | 858 | 626 | No annealing | 8.0 | Example |
| 9 | A6 | 1050 | 1186 | First to third passes | 65 | 851 | 692 | No annealing | 8.1 | Example |
| 10 | A7 | 1047 | 1185 | First to second passes | 66 | 866 | 702 | No annealing | 8.0 | Example |
| 11 | A8 | 1045 | 1183 | First to third passes | 65 | 864 | 667 | No annealing | 8.1 | Example |
| 12 | A9 | 1031 | 1175 | First to third passes | 65 | 863 | 705 | No annealing | 8.1 | Example |
| 13 | A10 | 1052 | 1188 | First to third passes | 66 | 865 | 643 | No annealing | 8.2 | Example |
| 14 | A11 | 1025 | 1171 | First to third passes | 65 | 852 | 672 | No annealing | 8.0 | Example |
| 15 | A12 | 1024 | 1171 | First to third passes | 65 | 861 | 646 | No annealing | 8.1 | Example |
| 16 | A13 | 1018 | 1167 | First to third passes | 66 | 869 | 653 | No annealing | 8.0 | Example |
| 17 | A14 | 1053 | 1188 | First to third passes | 65 | 858 | 702 | No annealing | 8.1 | Example |
| 18 | A15 | 1034 | 1176 | First to third passes | 66 | 854 | 703 | No annealing | 8.1 | Example |

TABLE 2-continued

| No. | Steel ID | Slab heating temperature [° C.] | Slab thickness (at start of first pass of hot rolling) [mm] | Hot rolling conditions: First pass: First pass start temperature [° C.] | First pass: First pass finish thickness [mm] | Second pass: Second pass start temperature [° C.] | Second pass: Second pass finish thickness [mm] | Third pass: Third pass start temperature [° C.] | Third pass: Third pass finish thickness [mm] | Fourth pass: Fourth pass start temperature [° C.] | Remarks |
|---|---|---|---|---|---|---|---|---|---|---|---|
| 19 | A16 | 1103 | 200 | 1089 | 150 | 1079 | 100 | 1067 | 70 | 1054 | Example |
| 20 | A1e | 1107 | 200 | 1092 | 149 | 1054 | 68 | 1021 | 59 | 1000 | Example |
| 21 | A1d | 1101 | 200 | 1088 | 148 | 1061 | 98 | 1033 | 89 | 1019 | Example |
| 22 | A1e | 1102 | 200 | 1087 | 152 | 1061 | 100 | 1032 | 70 | 1017 | Example |
| 23 | A1f | 1109 | 200 | 1089 | 148 | 1065 | 99 | 1033 | 71 | 1021 | Example |
| 24 | A1g | 1204 | 200 | 1184 | 151 | 1112 | 101 | 1032 | 70 | 1018 | Example |
| 25 | B1 | 1104 | 200 | 1092 | 150 | 1052 | 99 | 1012 | 70 | 998 | Comparative Example |
| 26 | B2 | 1109 | 200 | 1092 | 152 | 1062 | 100 | 1027 | 69 | 1015 | Comparative Example |
| 27 | B3 | 1154 | 200 | 1145 | 150 | 1131 | 100 | 1120 | 69 | 1108 | Comparative Example |
| 28 | A1h | 1100 | 200 | 1091 | 148 | 1060 | 129 | 1032 | 111 | 1020 | Comparative Example |
| 29 | A1i | 1109 | 200 | 1089 | 151 | 1065 | 101 | 1033 | 70 | 1018 | Comparative Example |
| 30 | A1j | 1103 | 200 | 1092 | 151 | 1062 | 100 | 1033 | 70 | 1015 | Comparative Example |
| 31 | B4 | 1111 | 200 | 1100 | 150 | 1072 | 101 | 1045 | 71 | 1032 | Comparative Example |
| 32 | B5 | 1147 | 200 | 1139 | 151 | 1119 | 99 | 1103 | 69 | 1089 | Comparative Example |
| 33 | A17 | 1102 | 200 | 1093 | 149 | 1059 | 100 | 1028 | 69 | 1015 | Example |
| 34 | A18 | 1105 | 200 | 1096 | 149 | 1064 | 99 | 1035 | 70 | 1020 | Example |
| 35 | A19 | 1110 | 200 | 1096 | 150 | 1075 | 99 | 1044 | 70 | 1025 | Example |
| 36 | A20 | 1108 | 200 | 1095 | 149 | 1066 | 100 | 1038 | 71 | 1018 | Example |

| No. | Steel ID | Hot rolling conditions: $T_1$ [° C.] | $T_2$ [° C.] | Rolling pass in temperature range of $T_1$ to $T_2$ | Cumulative rolling reduction in temperature range of $T_1$ to $T_2$ [%] | Rolling finish temperature [° C.] | Coiling temperature [° C.] | Hot-rolled sheet annealing temperature [° C.] | Thickness after completion of hot rolling [mm] | Remarks |
|---|---|---|---|---|---|---|---|---|---|---|
| 19 | A16 | 1065 | 1195 | First to third passes | 65 | 853 | 712 | No annealing | 8.1 | Example |
| 20 | A1e | 1031 | 1174 | First to second passes | 66 | 856 | 713 | No annealing | 8.1 | Example |
| 21 | A1d | 1031 | 1174 | First to third passes | 56 | 868 | 710 | No annealing | 8.2 | Example |
| 22 | A1e | 1031 | 1174 | First to third passes | 65 | 861 | 660 | No annealing | 5.2 | Example |
| 23 | A1f | 1031 | 1174 | First to third passes | 65 | 861 | 681 | No annealing | 12.9 | Example |
| 24 | A1g | 1031 | 1174 | First to third passes | 65 | 850 | 688 | No annealing | 8.1 | Example |
| 25 | B1 | 1010 | 1161 | First to third passes | 65 | 850 | 641 | No annealing | 8.1 | Comparative Example |
| 26 | B2 | 1026 | 1171 | First to third passes | 66 | 860 | 655 | No annealing | 8.2 | Comparative Example |
| 27 | B3 | 1119 | 1230 | First to third passes | 66 | 863 | 666 | No annealing | 8.0 | Comparative Example |
| 28 | A1h | 1031 | 1174 | First to third passes | 45 | 859 | 680 | No annealing | 8.1 | Comparative Example |
| 29 | A1i | 1031 | 1174 | First to third passes | 65 | 857 | 698 | 851 | 8.0 | Comparative Example |
| 30 | A1j | 1031 | 1174 | First to third passes | 65 | 862 | 490 | No annealing | 8.0 | Comparative Example |
| 31 | B4 | 1043 | 1182 | First to third passes | 65 | 870 | 670 | No annealing | 8.1 | Comparative Example |
| 32 | B5 | 1100 | 1216 | First to third passes | 66 | 865 | 681 | No annealing | 8.1 | Comparative Example |
| 33 | A17 | 1026 | 1172 | First to third passes | 66 | 873 | 685 | No annealing | 8.0 | Example |
| 34 | A18 | 1032 | 1175 | First to third passes | 65 | 876 | 683 | No annealing | 8.0 | Example |
| 35 | A19 | 1036 | 1178 | First to third passes | 65 | 888 | 695 | No annealing | 8.1 | Example |
| 36 | A20 | 1026 | 1172 | First to third passes | 65 | 862 | 682 | No annealing | 8.0 | Example |

Underlines indicate outside appropriate range.

TABLE 3

| No. | Steel ID | Thickness [mm] | Area ratio of crystal grains of 45 μm or more [%] | Evaluation result: Blanking workability | Evaluation result: Corrosion resistance | Remarks |
|---|---|---|---|---|---|---|
| 1 | A1a | 8.0 | 11 | Pass | Good | Example |
| 2 | A1a | 8.0 | 19 | Pass | Good | Example |
| 3 | A1a | 8.0 | 12 | Pass | Good | Example |
| 4 | A1b | 8.2 | 15 | Pass | Good | Example |
| 5 | A2 | 8.1 | 6 | Pass | Good | Example |
| 6 | A3 | 8.2 | 10 | Pass | Good | Example |
| 7 | A4 | 8.1 | 9 | Pass | Good | Example |
| 8 | A5 | 8.0 | 4 | Pass | Good | Example |
| 9 | A6 | 8.1 | 13 | Pass | Good | Example |
| 10 | A7 | 8.0 | 16 | Pass | Good | Example |
| 11 | A8 | 8.1 | 1 | Pass | Good | Example |
| 12 | A9 | 8.1 | 20 | Pass | Good | Example |
| 13 | A10 | 8.2 | 10 | Pass | Good | Example |
| 14 | A11 | 8.0 | 11 | Pass | Excellent | Example |
| 15 | A12 | 8.1 | 5 | Pass | Excellent | Example |
| 16 | A13 | 8.0 | 17 | Pass | Good | Example |
| 17 | A14 | 8.1 | 9 | Pass | Good | Example |
| 18 | A15 | 8.1 | 13 | Pass | Good | Example |
| 19 | A16 | 8.1 | 13 | Pass | Good | Example |
| 20 | A1e | 8.1 | 8 | Pass | Good | Example |
| 21 | A1d | 8.2 | 18 | Pass | Good | Example |
| 22 | A1e | 5.2 | 10 | Pass | Good | Example |
| 23 | A1f | 12.9 | 12 | Pass | Good | Example |
| 24 | A1g | 8.1 | 19 | Pass | Good | Example |
| 25 | B1 | 8.1 | 3 | Pass | Poor | Comparative Example |
| 26 | B2 | 8.2 | 21 | Fail | Good | Comparative Example |
| 27 | B3 | 8.0 | 29 | Fail | Good | Comparative Example |
| 28 | A1h | 8.1 | 28 | Fail | Good | Comparative Example |
| 29 | A1i | 8.0 | 63 | Fail | Good | Comparative Example |
| 30 | A1j | 8.0 | 17 | Fail | Good | Comparative Example |
| 31 | B4 | 8.1 | 25 | Fail | Good | Comparative Example |
| 32 | B5 | 8.1 | 9 | Pass | Poor | Comparative Example |
| 33 | A17 | 8.0 | 16 | Pass | Good | Example |
| 34 | A18 | 8.0 | 15 | Pass | Good | Example |
| 35 | A19 | 8.1 | 20 | Pass | Good | Example |
| 36 | A20 | 8.0 | 13 | Pass | Good | Example |

Underlines indicate outside appropriate range.

As can be seen in Tables 1 to 3, in all Examples, a ferritic stainless steel sheet of 5.0 mm or more in thickness having excellent blanking workability and excellent corrosion resistance was obtained.

Regarding Comparative Examples, in No. 25, steel B1 whose Cr content was below the appropriate range was used, so that the desired corrosion resistance was not achieved.

In No. 26, steel B2 whose Ni content was below the appropriate range was used, so that the area ratio of crystal grains of 45 μm or more in grain size was more than 20% and the desired blanking workability was not achieved.

In No. 27, steel B3 whose Cr content was above the appropriate range was used, so that the area ratio of crystal grains of 45 μm or more in grain size was more than 20% and the desired blanking workability was not achieved.

In No. 28, the cumulative rolling reduction in the temperature range of $T_1$ [° C.] to $T_2$ [° C.] was below the appropriate range, so that the area ratio of crystal grains of 45 μm or more in grain size was more than 20% and the desired blanking workability was not achieved.

In No. 29, the hot-rolled sheet annealing temperature was above the appropriate range, so that the area ratio of crystal grains of 45 μm or more in grain size was more than 20% and the desired blanking workability was not achieved.

In No. 30, the coiling temperature in the hot rolling was below the appropriate range, so that a large amount of martensite phase formed and the desired blanking workability was not achieved.

In No. 31, steel B4 whose Si content was above the appropriate range was used, so that the area ratio of crystal grains of 45 μm or more in grain size was more than 20% and the desired blanking workability was not achieved.

In No. 32, steel B5 whose Mn content was above the appropriate range was used, so that MnS forming an initiation point of corrosion precipitated excessively and as a result the predetermined corrosion resistance was not achieved.

INDUSTRIAL APPLICABILITY

A ferritic stainless steel sheet according to the present disclosure is particularly suitable for use in parts that are thick and are required to have high blanking workability and high corrosion resistance, such as flanges of exhaust system parts of automobiles.

The invention claimed is:

1. A ferritic stainless steel sheet comprising:

a chemical composition consisting of, in mass %,

C: 0.001% to 0.020%,

Si: 0.05% to 1.00%,

Mn: 0.05% to 1.50%,

P: 0.04% or less,

S: 0.010% or less,

Al: 0.001% to 0.300%,

Cr: 10.0% to 13.0%,

Ni: 0.65% to 1.50%,
Ti: 0.15% to 0.35%, and
N: 0.001% to 0.020%,
with a balance consisting of Fe and inevitable impurities;
an area ratio of crystal grains of 45 μm or more in grain size of 20% or less; and
a thickness of 5.0 mm or more,
wherein the ferritic stainless steel sheet has excellent blanking workability and excellent corrosion resistance.

2. A ferritic stainless steel sheet comprising:
a chemical composition consisting of, in mass %,
C: 0.001% to 0.020%,
Si: 0.05% to 1.00%,
Mn: 0.05% to 1.50%,
P: 0.04% or less,
S: 0.010% or less,
Al: 0.001% to 0.300%,
Cr: 10.0% to 13.0%,
Ni: 0.65% to 1.50%,
Ti: 0.15% to 0.35%, and
N: 0.001% to 0.020%, and
optionally, one or more selected from: Cu: 0.01% to 1.00%, Mo: 0.01% to 1.00%, W: 0.01% to 0.20%, Co: 0.01% to 0.20%, V: 0.01% to 0.20%, Nb: 0.01% to 0.10%, Zr: 0.01% to 0.20%, B: 0.0002% to 0.0050%, REM: 0.001% to 0.100%, Mg: 0.0005% to 0.0030%, Ca: 0.0003% to 0.0050%, Sn: 0.001% to 0.500%, and Sb: 0.001% to 0.500%,
with a balance consisting of Fe and inevitable impurities;
an area ratio of crystal grains of 45 μm or more in grain size of 20% or less; and
a thickness of 5.0 mm or more,
wherein the ferritic stainless steel sheet has excellent blanking workability and excellent corrosion resistance.

3. A method for producing the ferritic stainless steel sheet according to claim 1, the method comprising the following (a) and (b) and optionally comprising the following (c):
(a) heating a slab having a chemical composition to a temperature range of 1050° C. or more and 1250° C. or less, wherein the chemical composition consists of, in mass %, C: 0.001% to 0.020%, Si: 0.05% to 1.00%, Mn: 0.05% to 1.50%, P: 0.04% or less, S: 0.010% or less, Al: 0.001% to 0.300%, Cr: 10.0% to 13.0%, Ni: 0.65% to 1.50%, Ti: 0.15% to 0.35%, and N: 0.001% to 0.020%, with a balance consisting of Fe and inevitable impurities;
(b) subjecting the slab to hot rolling at a cumulative rolling reduction in a temperature range of $T_1$ [° C.] to $T_2$ [° C.] of 50% or more and a coiling temperature of 500° C. or more, to obtain a hot-rolled steel sheet; and
(c) subjecting the hot-rolled steel sheet to hot-rolled sheet annealing in a temperature range of 600° C. or more and less than 800° C.,
wherein $T_1$ and $T_2$ are respectively defined by the following formulas (1) and (2):

$$T_1[°\ C.]=144Ni+66Mn+885 \quad (1)$$

$$T_2[°\ C.]=91Ni+40Mn+1083 \quad (2)$$

where Ni and Mn in formulae (1) and (2) are respectively Ni content and Mn content in mass % in the chemical composition of the slab.

4. A method for producing the ferritic stainless steel sheet according to claim 2, the method comprising the following (a) and (b) and optionally comprising the following (c):
(a) heating a slab having a chemical composition to a temperature range of 1050° C. or more and 1250° C. or less, wherein the chemical composition consists of, in mass %, C: 0.001% to 0.020%, Si: 0.05% to 1.00%, Mn: 0.05% to 1.50%, P: 0.04% or less, S: 0.010% or less, Al: 0.001% to 0.300%, Cr: 10.0% to 13.0%, Ni: 0.65% to 1.50%, Ti: 0.15% to 0.35%, and N: 0.001% to 0.020%, and optionally, one or more selected from: Cu: 0.01% to 1.00%, Mo: 0.01% to 1.00%, W: 0.01% to 0.20%, Co: 0.01% to 0.20%, V: 0.01% to 0.20%, Nb: 0.01% to 0.10%, Zr: 0.01% to 0.20%, B: 0.0002% to 0.0050%, REM: 0.001% to 0.100%, Mg: 0.0005% to 0.0030%, Ca: 0.0003% to 0.0050%, Sn: 0.001% to 0.500%, and Sb: 0.001% to 0.500%, with a balance consisting of Fe and inevitable impurities;
(b) subjecting the slab to hot rolling at a cumulative rolling reduction in a temperature range of $T_1$ [° C.] to $T_2$ [° C.] of 50% or more and a coiling temperature of 500° C. or more, to obtain a hot-rolled steel sheet; and
(c) subjecting the hot-rolled steel sheet to hot-rolled sheet annealing in a temperature range of 600° C. or more and less than 800° C.,
wherein $T_1$ and $T_2$ are respectively defined by the following formulas (1) and (2):

$$T_1[°\ C.]=144Ni+66Mn+885 \quad (1)$$

$$T_2[°\ C.]=91Ni+40Mn+1083 \quad (2)$$

where Ni and Mn in formulae (1) and (2) are respectively Ni content and Mn content in mass % in the chemical composition of the slab.

* * * * *